United States Patent [19]

Skobel

[11] Patent Number: 4,651,390

[45] Date of Patent: Mar. 24, 1987

[54] RELEASABLE CLASP

[76] Inventor: Max Skobel, 10 Lynwood Rd., Edison, N.J. 08817

[21] Appl. No.: 763,973

[22] Filed: Aug. 9, 1985

Related U.S. Application Data

[63] Continuation-in-part of Ser. No. 500,374, Jun. 2, 1983, Pat. No. 4,534,090, which is a continuation-in-part of Ser. No. 303,790, Sep. 21, 1981, Pat. No. 4,408,375.

[51] Int. Cl.[4] ..... A44B 11/25

[52] U.S. Cl. ..... 24/625

[58] Field of Search ..... 70/459; 24/614–618, 24/623, 625, 633

[56] References Cited

U.S. PATENT DOCUMENTS

| | | | |
|---|---|---|---|
| 874,957 | 12/1907 | Godley | 24/625 X |
| 2,330,770 | 9/1943 | Wiley | 24/618 X |
| 3,167,835 | 2/1965 | Bengtsson | 24/625 |
| 3,181,189 | 5/1965 | Leyden | 24/615 X |
| 3,345,706 | 10/1967 | Stokes | 24/625 X |
| 3,979,934 | 9/1976 | Isenmann | 24/615 X |
| 4,389,759 | 6/1983 | Yuda | 24/625 X |
| 4,408,375 | 10/1983 | Skobel | 24/625 X |
| 4,534,090 | 8/1985 | Skobel | 24/625 |

FOREIGN PATENT DOCUMENTS

| | | | |
|---|---|---|---|
| 2323633 | 11/1974 | Fed. Rep. of Germany | 24/625 |

*Primary Examiner*—Kenneth J. Dorner
*Assistant Examiner*—James R. Brittain
*Attorney, Agent, or Firm*—Goodman & Teitelbaum

[57] ABSTRACT

A releasable clasp including a male insert member and a female receiving member, the female receiving member including a passageway having a single retaining slot in one wall. An abutment projects into the passageway from an opposing wall. The male insert member includes a body portion supporting a pair of forwardly directed springy arms which are insertable into the passageway. One of the arms serves as a guiding arm, and includes a nose portion and an inwardly stepped surface longitudinally extending rearwardly from the nose portion and terminating in a shoulder. The other arm serves as a locking arm, and includes a locking tab for entry into the retaining slot. Teh nose portion is spaced forward of and overlaps the locking tab. Upon entry of the arms into the passageway, the shoulder causes deflection of the guiding arm toward the locking arm until further inspection brings about the entry of the locking tab into the retaining slot. The male insert member can be fully inserted in only one orientation into the passageway. The abutment prevents full insertion into the passageway when attempting to insert the male insert member in an incorrect orientation.

19 Claims, 7 Drawing Figures

RELEASABLE CLASP

RELATIONSHIP TO OTHER APPLICATIONS

This is a continuation-in-part application of copending application Ser. No. 500,374 filed on June 2, 1983 for a "Releasable Clasp", now U.S. Pat. No. 4,534,090 which in turn was a continuation-in-part application of application Ser. No. 303,790, filed on Sept. 21, 1981 for a "Releasable Connector", now U.S. Pat. No. 4,408,375.

BACKGROUND OF THE INVENTION

This invention relates to a connector, and more particularly to a releasable connector which can be easily assembled and disengaged, and specifically of a type usable on articles of jewelry.

In numerous fields, it is necessary to provide a releasable connector which can be easily engaged for retention in a secure position, and easily disengaged. Such connectors are typically utilized in the jewelry industry for interconnecting necklaces, bracelets, keychains, and other lengths of jewelry which must be connected in a continuous loop. In the case of a jewelry clasp, the clasp must be of a type that can be easily manipulated, especially by one hand, since often the closure must be made around the wrist, as for example when connecting a bracelet, where only one hand can be utilized. Similarly, it must be of a type that can be manipulated even without seeing the clasp, as for example when connecting a necklace on the back of the neck. At the same time, because such clasps are typically made of precious metal, such as gold, silver, platinum, and the like, the clasp must be of a small type and made of parts requiring a limited amount of the precious material.

In the aforementioned U.S. Pat. No. 4,408,375, there is described one type of releasable connector having a receiving member with an internal passageway engaged by a male member insertable into the passageway. A pair of diametrically opposed retaining slots are spaced along the passageway. The male insert member has a pair of bifurcated springy legs which are insertable into the passageway as the legs are compressed together. At the end of each of the legs is provided an outwardly extending foot which can reasonably lock into each of the retaining slots. After the legs are inserted, as the feet reach the retaining slots, the legs spread apart so that the feet are secured within the retaining slots.

The aforementioned co-pending application Ser. No. 500,374 provides an improvement on the aforementioned patent by including an inwardly extending finger projecting from each of the feet portions. One of the fingers is spaced in front of and in overlapping relationship with the other finger to thereby define a unitary leading insertion portion for entry of the male insert member into the passageway. This facilitates insertion and avoids the possibility of having one of the legs straddling on the outside of the passageway.

Although such releasable clasps are effective, they both utilize two slots along the passageway with two corresponding foot portions, each of which must engage into a respective slot. This requires releasing both of the foot portions at the same time from their respective slots in order to open the clasp. Often, this can be awkward when only one hand can be utilized for the manipulation of the clasp. Similarly, when releasing the clasp from behind the neck, it may be difficult to achieve release of both foot portions simultaneously.

An additional problem occurs with certain types of jewelry which require that the ends of the jewelry must be interconnected in a polarized or single orientation. Frequently, bracelets, necklaces and the like, have a pattern along one surface of the jewelry, and when the opposing ends of the jewelry are connected, the ends must be connected only in one orientation in order to maintain a continuous pattern. This is also the case where a necklace has a design on one side and must lie flat on the neck to view the design. In order to maintain such flat arrangement, the necklace must be closed in only one orientation. Inverting the clasp causes the necklace to twist and prevents the necklace from lying flat.

According to the clasps heretofore described, it is possible to insert the male insert member into the female receiving member in either of two orientations. Since there were two legs, each of which had a foot portion engaging in a corresponding slot, the male member could be inverted and the feet inserted in either of the two opposing slots, and still achieve proper closure.

Accordingly, while the aforementioned releasable clasp have been quite effective, in specific cases improvements are warranted in the type of releasable clasp being used.

SUMMARY OF THE INVENTION

Accordingly, it is an object of the present invention to provide a releasable clasp which avoids the aforementioned problems of the prior art devices.

Another object of the present invention is to provide a releasable clasp which can be utilized for interconnecting two items, such as the ends of an article of jewelry.

Still another object of the present invention is to provide a releasable clasp which can be easily interconnected and easily separated.

Yet a further object of the present invention is to provide a releasable clasp having a male insert portion insertable into the passageway of a female receiving member, and wherein the male portion can be inserted in only one orientation with respect to the female portion.

A further object of the present invention is to provide a releasable clasp having an elongated male member insertable in the passageway of a female member, with the male member supporting a pair of bifurcated legs, one of the legs serving as a locking leg and having a locking tab which catches into a retaining slot provided along the passageway of the female member.

Briefly, in accordance with the present invention, there is provided a releasable clasp including a female receiving member and an elongated male insert member. The female member includes an elongated internal passageway extending from a mouth at one end thereof. A single retaining slot extends through a wall of the female member at a position along the passageway. Along the passageway, closer to the mouth, there is provided an abutment which projects from an opposing wall of the female member into the passageway.

The male member includes a body portion supporting a pair of elongated forwardly directed spaced apart flexible arms, one of which serves as a guiding arm and the other of which serves as a locking arm. An inwardly stepped abutment surface extends along the lateral edge of the guiding arm from its free end, terminating in a shoulder which forms a cam surface engaging the mouth of the passageway during insertion of the male member to inwardly deflect the guiding arm toward the locking arm. A notch formed along the lateral edge of the locking arm releasably locks into the slot of the female member when the locking arm spreads apart from the guiding arm to thereby retain the male member locked in the female member.

The stepped abutment surface of the guiding arm of the male member accommodates the projecting abutment of the female member which can slide therealong as the male member is inserted. However, this only occurs as the male member is inserted in the orientation with the guiding arm facing the abutment of the female member. When the male member is inserted in an opposing orientation direction with the locking arm facing the abutment of the female member, the abutment limits the insertion of the male member to prevent the full engagement of the male member in the female member.

BRIEF DESCRIPTION OF THE DRAWINGS

With the above and additional objects and advantages in view, as will hereinafter appear, this invention comprises the devices, combinations and arrangements of parts hereinafter described by way of example, and illustrated in the accompanying drawings of a preferred embodiment in which.

In the various figures of the drawings, like reference characters designate like parts.

DETAILED DESCRIPTION OF THE PREFERRED EMBODIMENT

Figure 1:
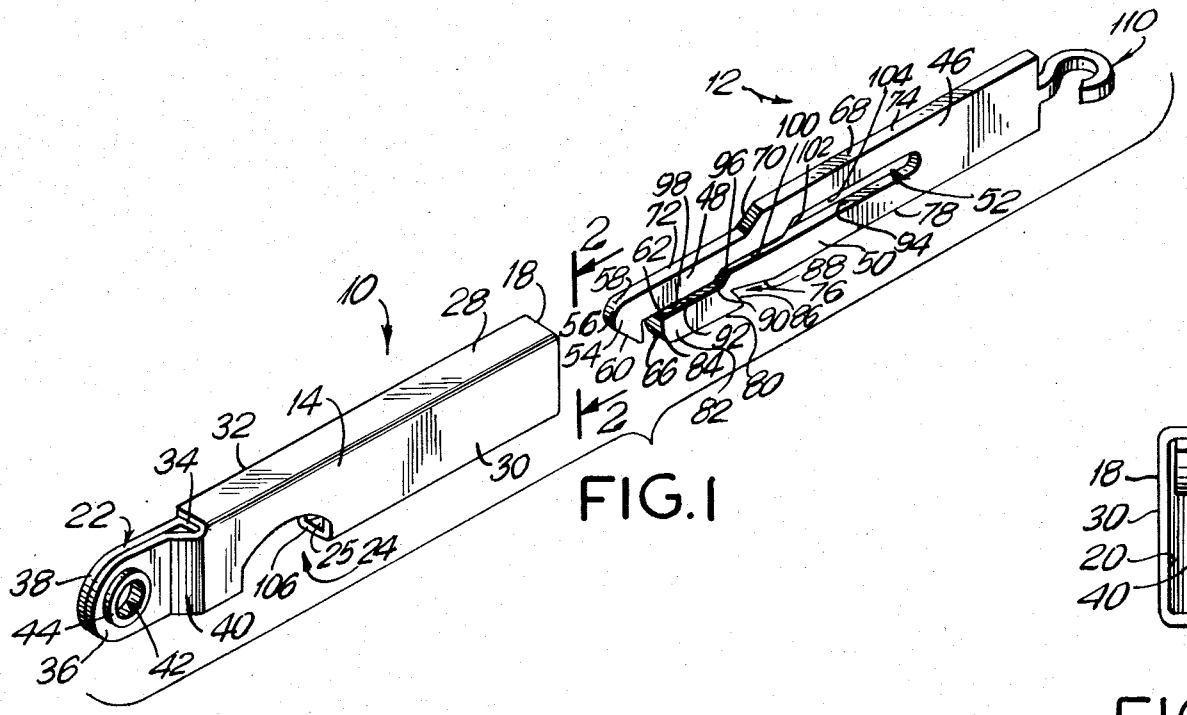
FIG. 1 is a perspective view of the releasable clasp in accordance with the present invention, showing the male and female members in a separated condition.
Figure 2:
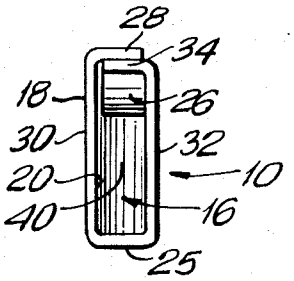
FIG. 2 is an end elevational view of the female member taken along line 2—2 of FIG. 1.

Referring now to the drawings, FIG. 1 shows the releasable clasp including a female receiving member 10 and a male insert member 12. The female receiving member 10 includes a hollow body portion 14 which provides an elongated internal passageway 16 extending from a forward edge 18 of the body portion 14. The forward edge 18 is open to provide a mouth 20 for the passageway 16. The rear end of the passageway 16 is closed and terminates with a tail portion 22. A single cutout 24 is provided along one lateral side edge 25 of the body portion 14 to define a retaining slot therethrough. An abutment 26 projects from the opposing lateral side edge 28 of the passageway and projects into the passageway 16. Both the slot 24 and the abutment 26 are rearward of the passageway mouth 20, preferrably disposed adjacent the tail portion 22, with the abutment being slightly closer to the mouth 20.

The female receiving member 10 is shown fabricated from a single sheet of material, preferrably metal, which is folded over to define a substantially rectangular configuration with an opposing pair of spaced apart side walls 30, 32 and the lateral edge walls 25, 28. The sheet of material forming the female receiving member 10 has its ends overlapping at edge wall 28 to include a lower inner layer wall 34 beneath the upper outer edge wall 28. The abutment 26 can be formed from the lower layer wall 34 in a manner well known in the art. The overlapping layer wall 28, 34, if required, can be joined together by means of solder or any other means of a suitable type of securing material. Alternately, if the material is of sufficient strength, the female receiving member can be retained in shape without any type of securing means. It is further noted, that the female receiving member could be formed of a rigid plastic material.

The two sections of the tail portion 22 are formed by pressing a forward wall 36 against its opposing rear wall 38, with a transversely extending sloped ridge 40 being thus provided on the forward side of the female receiving member 10 at the junction between the side wall 30 of the body portion 14 and forward wall 36 of the tail portion 22. A centrally located aperture 42 is formed perpendicularly through the two tail portion walls 36, 38 so that the aperture 42 is spaced from the peripheral edges of the tail portion 22 in addition to being spaced from the sloped ridge 40. A peripheral collar 44 can be formed around the aperture 42 by striking the material from the tail portion rear wall 38 to project into the aperture 42 formed in the tail portion front wall 36, thereby locking the two tail portion walls 36, 38 together.

Although the female receiving member is shown to have a substantially flattened, elongated, substantially rectangular shape, other suitable shapes could be similarly provided. For example, a flattened shape with upper and lower arcuate edges could be formed, as in the aforementioned co-pending application.

The male insert member 12 includes a substantially flat body portion 46 supporting a pair of forwardly directed, spaced apart spring arms 48, 50 separated by an elongated slot 52. Arm 48 defines a guiding arm, and arm 50 defines a locking arm. Guiding arm 48 projects beyond the free end of locking arm 50, and terminates in a nose 54 having a rounded arcuate tip 56 and a pair of rearwardly extending, outwardly flared, opposing cam surfaces 58, 60. The rearward side of the nose 54 includes a substantially L-shaped seat 62 which limits the deflection of the locking arm 50 as the arm 50 abuts the seat 62. The nose 54 overlaps the free end 66 of the locking arm 50, thereby providing a forward leading portion for entry into the mouth 20 of the female receiving member 10, thus preventing the bifurcated arm 48, 50 from straddling on either lateral edge wall 25 or 28 of the female passageway 16.

Figure 3:
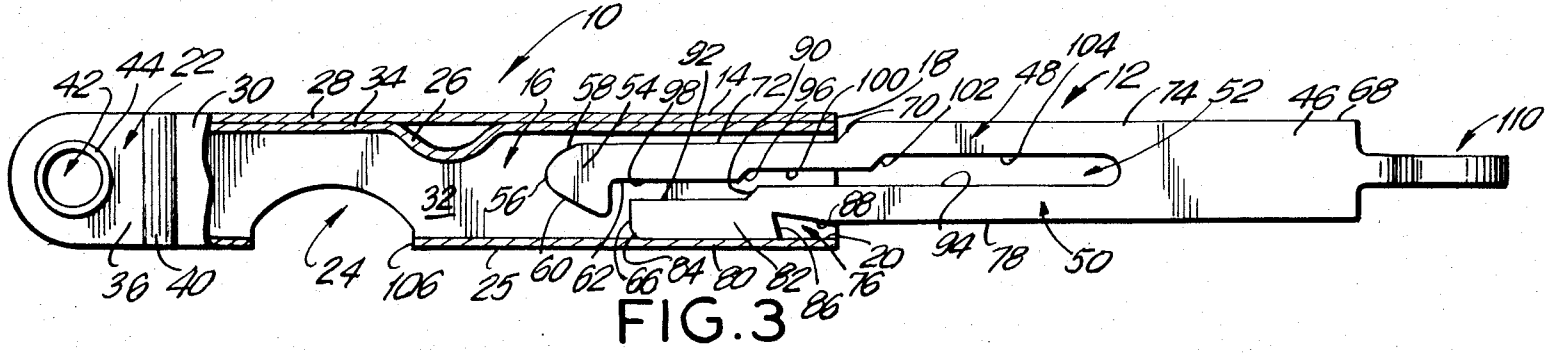
FIG. 3 is a cross sectional view showing the initial insertion of the elongated male insert member into the female receiving member.

The lateral edge 68 of the guiding arm 48 is stepped, looking from its forward nose 54, partly the edge 68, the step is defined by a rearwardly angled step riser 70. The step riser 70 separates the forward lower stepped portion 72 from the rearward stepped portion 74. As the male member 12 enters the passageway 16, the step riser 70 forms a cam surface which rides along the edge of the mouth 20 of the female member 10 to guide the upper stepped portion 74 into the passageway 16, as shown in FIG. 3. This causes deflection of the locking arm 50 towards the guiding arm 48, as will hereinafter be described.

A notch 76 is provided along the lateral edge 78 of the locking arm 50. The lateral edge 80, forward of the notch 76, extends transversely outwardly slightly beyond the lateral edge 78 of the remaining rear portion of the locking arm 50 which is rearward of the notch 76. The lateral edge 80 defines a locking tab portion 82. The length of the locking tab portion 82 is approximately equal to the longitudinal length of the slot 24 so that the tab portion 82 can be received within the slot 24, as will hereinafter be explained. At the forward outer edge of the locking tab portion 82, there is provided an arcuate nose portion 84 forming an abutment edge.

The notch 76 has substantially an inverted V-shape, including a first inclined surface 86 extending from the lateral edge 80 of the locking tab portion 82. The angle of incline is slightly less than perpendicular with respect to the lateral edge 80 so as to form a sharo angle therewith. The other inclined surface 88 of the notch 76 forms a shallow angle with the lateral edge 78 so as to extend rearwardly in an outwardly direction.

The inner slot 52 separating the arms 48, 50 has a number of stepped sections. On the inner side of the locking arm 50, there is provided a step riser 90 separating a lower stepped surface 92 at the distal edge from an upper stepped surface 94 at the rearward part of the arm 50. The step riser 90 is slightly forwardly spaced from the longitudinal location of the notch 76, and specifically extends into the locking tab portion 82.

On the opposing side of the slot 52, and specifically along the inner side of the guiding arm 48, there is provided a first step riser 96 separating a first stepped surface 98 at the forward end from a second stepped surface 100 rearward thereof. The step riser 96 is matingly positioned adjacent the step riser 90 on the opposing side of the slot 52, and serves to thicken the forward position of the guiding arm 48. A second step riser 102 separates the second stepped surface 100 from a third rearward stepped surface 104. The second step riser 102 is slightly rearwardly spaced from the location of the step riser or shoulder 70 on the outer lateral edge of the guiding arm 48. The second step riser 102 provides for the enlargement laterally of the slot 52 so that the arms 48, 50 can be more springy. All of the step risers 90, 96, 102 are rearwardly angled.

The male insert member 12 is formed substantially flat so as to be able to fit between the side walls 30, 32 defining the passageway 16 in the female member 10. The male insert member 12 is formed of springy material such as steel, gold, plastic, or the like. The longitudinal length of the slot 52 will depend upon the resiliency of the springy material in order to provide sufficient deflection of the locking arm 50 and/or the guiding arm 48, so that the male member 12 will fit within the passageway 16.

Initial insertion of the male insert member 12 into the female receiving member 10 occurs with the leading nose portion 54 guiding both arms 48, 50 into the mouth 20 of the passageway 16. The combined lateral width of the undeflected arms 48,50 at the forward portion in front of the notch 76 is slightly less than the transverse width of the passageway 16, as shown in FIG. 3, so as to permit entry of the male insert member 12 into the female member 10.

Figure 4:
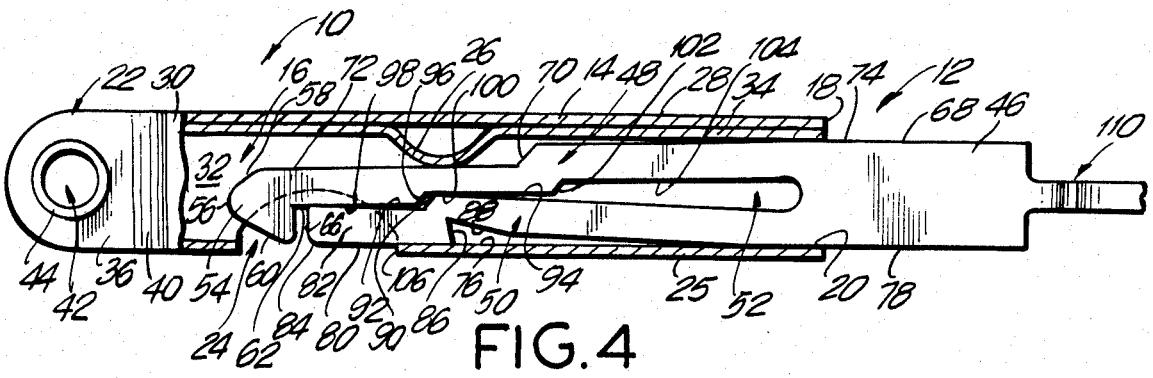
FIG. 4 is a cross sectional view similar to that shown in FIG. 3, showing the progression of the male insert member within the female member.

As shown in FIG. 3, the entry proceeds until the shoulder 70 is reached. At that point, the shoulder 70 provides a cam surface for sliding along the edge of the mouth 20 of the passageway 16 so as to move the guiding arm 48 of the male member downwardly to permit the lateral edge 74 of the guiding arm 48 to enter into the passageway 16. The overall transverse width of the male member as measured from the outer lateral edge 80 of the locking tab portion 82 to the outwardly most stepped surface 74 of the guiding arm 48 is such as to be wider than the transverse width of the passageway 16. As a result, the locking arm 50 is deflected toward the guiding arm 48, as is shown in FIG. 4.

The presence of the lower stepped abutment surface 72 along the forward lateral edge of the locking arm 48 accommodates for the sliding of the abutment 26 therealong as the progression of the male insert member proceeds within the passageway 16 of the female member 10. The deflected locking arm 50 causes the adjacent step risers 90, 96 to approach each other and causes the inner side 92 of the locking tab 82 to abut against the inner side 98 of the arm 48 within the seat portion 62 formed on the inner side of the nose 54. The stepped surface 94 on the inner side of the locking arm 50 will also abut against the stepped surface 100 on the inner side of the guiding arm 48.

Figure 5:
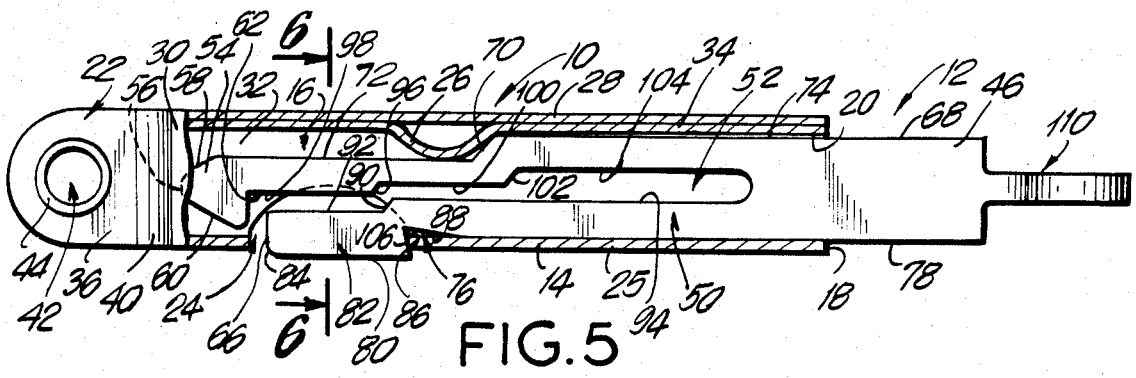
FIG. 5 is a cross sectional view similar to that shown in FIGS. 3 and 4, showing the male member locked within the female member.
Figure 6:
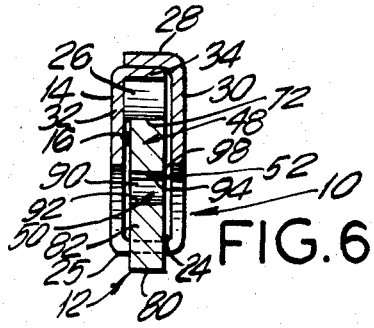
FIG. 6 is a cross sectional view taken along line 6—6 of FIG. 5.

With the locking arm 50 deflected against the guiding arm 48, the male member 12 continues its progression within the passageway 16 until the locking tab portion 82 reaches the slot 24. The locking tab portion 82 then enters into the slot 24 causing the guiding arm 48 to spread apart from the locking arm 50, as best shown in FIG. 5. At this point, the first inclined surface 86 of the notch 76 engages the lateral end wall 106 of the side edge 25 at the slot 24 so as to retain the locking tab portion 82 locked within the slot 24. The rearwardly angled second inclined surface 88 provides an undercut portion to ensure that the notched junction between the surfaces 86, 88 of the notch 76 engages the end wall 106 of the slot 24 and remains in the locked position. It is noted that the transverse width of the male member 12 from the outer surface 74 of the guiding arm 48 to the outer surface 78 of the locking arm 50 is approximately equal to or slightly less than the transverse width of the passageway 16, as shown in FIG. 5.

The shoulder 70 can be spaced longitudinally along the length of the guiding arm 48 so as to provide an abutment surface for the abutment 26, as shown in FIG. 5, whereby the abutment 26 serves as a limiting stop for the insertion of the male member 12. Such stop can occur just after the locking tab portion 82 enters into the slot 24. The slot 24 can be so spaced such that it prevents the forward nose 54 from hitting against the sloped ridge 40 at the closed end of the passageway 16, thus preventing damage to the nose 54 or to the female member 10.

The male member 12 remains locked within the female member 10 until release. Release occurs by depressing the locking tab portion 82 so as to release the angled surface 86 of the notch 76 from the end wall 106 of the slot 24 and to dispose the locking tab portion 82 internally of the passageway 16. The guiding arm 48 will then be deflected towards the locking arm 50, and the two arms 48, 50 will be spaced close enough together so that the male member 12 can be extracted from the passageway 16, in a manner indicated in FIG. 4.

It should be appreciated, that the lower stepped surface 72 at the forward end of the guiding arm 48 provides a sliding contact surface along which the abutment 26 can slide, during both insertion and removal of the male member 12. This occurs when the guiding arm 48 is in an orientation adjacent to the abutment 26. The stepped surface 72 is sufficient to accommodate the projecting abutment 26 of the passageway 16, permitting it to slide along the surface 72.

The present arrangement is such that it will prevent an inverted insertion of the male member 12 with respect to the female member 12. If the male member 12 is inserted into the passageway 16 such that the guiding arm 48 is not adjacent to the abutment 26, where, on the contrary, the locking arm 50 is adjacent to the abutment 26, the male member 12 will be prevented from locking into the female member 10.

Figure 7:
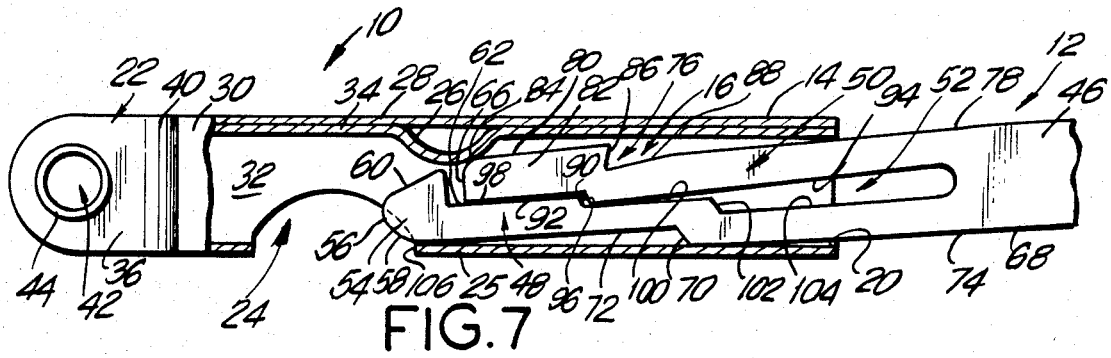
FIG. 7 is a cross sectional view similar to that shown in FIGS. 3-5, showing the limitation of insertion of the male member when insertion is attempted in the wrong orientation direction with respect to the female member.

Specifically, as shown in FIG. 7, initial entry will be permitted since the transverse width at the forward end of the male member 12 is less than the transverse width of the passageway 16. Then, as the shoulder 70 is reached, the two arms 48, 50 will be forced into a compressed relationship, in the manner set forth above. This compressed relationship will permit entry into the female member 10 for only a limited portion of the distance, since the transverse width of the compressed arms 48, 50 together is also less than the transverse width of the passageway 16. However, the insertion will change when the abutment 26 is reached.

At that point, the cam surface 60 of the nose 54 engages the abutment 26 and forces the nose 54 to pivot towards the side edge 25 so that there is no longer provided a horizontal surface along which the abutment 26 can be accommodated. The shoulder 70 causes the stepped surface 72 to be inclined relative to the side edge 25 of the female member 10, as shown in FIG. 7, so that the edge 80 of the tab portion 82 is also inclined to provide a wedge surface. Accordingly, further passage into the female member 10 will be restricted when the wedge surface 80 engages the abutment 26. The arcuate nose edge 84 at the forward end of the locking tab portion 82 will engage the abutment 26, and the wedge surface 80 will prevent further entry of the male member 12.

Since the abutment 26 is positioned rearward of the slot 24, the limitation of insertion will occur before the slot 24 is reached, thereby preventing entry of the entire nose 54 into the slot 24. Of course, since the locking tab portion 82 is now on the opposing side of the slot 24, no entry of the locking tab portion 82 into the slot 24 could occur, and the clasp cannot be locked. Because the arms 48, 50 are springy, the abutment 26 will limit the movement during the wedging action, which will not damage the male member.

Accordingly, it will be appreciated that the male insert member 12 can only be fully received and locked within the female receiving member 10 in a correct orientation. Should the insertion be attempted in an inverse orientation, initial entry may be permitted. However, by the abutment 26 to immediately warn the user thereof, where no locking of the male member 12 and the female member 10 would occur. Pieces of jewelry can therefore be connected in only one orientation. This would permit a continuity of design between the opposing ends of the jewelry.

Even if the individual could not see the clasp, as for example when closing the clasp of a necklace from behind the neck, should the user attempt to close the jewelry in the wrong direction, the clasp will not close. The user would then invert the respective male and female members in order to provide the proper mating relationship between the male and female members of the clasp. However, without the abutment 26 feature of the present invention, the user would be able to fully insert the male member into the female member in the wrong orientation, and would believe the clasp was closed when actually the clasp was unlocked.

In order to permit attachment to the male end of the clasp, a hook 110 is provided at the end of the body portion 46 of the male insert member 12. Alternately, an aperture in the body portion 46 or other attaching arrangement could be provided. In this manner, the hook 110 of the male member and the aperture 42 of the female member are utilized at the opposing remote ends of the clasp to attach a piece of jewelry such as a chain, bracelet, necklace or the like.

It should be appreciated, that other types of arrangements could utilize the present releasable clasp. For example, a keychain or key arrangement could be connected to the ends of the clasp.

Numerous alterations of the structure herein disclosed will suggest themselves to those skilled in the art. However, it is to be understood that the present disclosure relates to a preferred embodiment of the invention which is for the purpose of illustration only, and is not be construed as a limitation of the present invention.

What is claimed is:

1. A releasable clasp comprising:

a female receiving member having opposing longitudinal side walls and opposing first and second longitudinal edges providing an elongated internal passageway extending from one end thereof, and a retaining slot positioned along said passageway, said retaining slot being an opening extending through said first longitudinal edge of said female receiving member, said passageway including a mouth at said one end;

a substantially flat elongated male insert member having a pair of elongated forwardly directed, spaced apart, springy arms insertable into said passageway, said springy arms being a guiding arm and a locking arm;

said guiding arm including an inwardly stepped surface longitudinally extending along a lateral edge from a free forward end thereof, said stepped surface terminating rearwardly at an outwardly extending shoulder disposed on said guiding arm;

said shoulder providing a cam surface for engaging a wall of said passageway mouth during insertion of said male insert member into said passageway so that said guiding arm is deflected towards said locking arm;

said locking arm including an outwardly extending tab portion at a forward end thereof for releasably locking into said retaining slot when said locking arm springs apart from said guiding arm when said male insert member has been inserted in a correct orientation with said locking arm being inserted adjacent to said first longitudinal edge of said female receiving member, said tab portion extending through said opening when in said correct orientation to securely retain said male insert member in said female receiving member in a locked position;

abutment means within said passageway to prevent full insertion of said guiding and locking arms into said passageway when said male insert member has been inserted in an incorrect orientation with said guiding arm being inserted adjacent to said first longitudinal edge of said female receiving member;

said abutment means including an abutment portion projecting into said passageway from said second longitudinal edge of said female receiving member, said abutment portion being disposed longitudinally closer to said mouth than said retaining slot; and said shoulder being disposed a predetermined distance longitudinally rearwardly from said tab portion so that said stepped surface can pass by said abutment portion in said correct orientation, and said tab portion engages said abutment portion in said incorrect orientation.

2. A releasable clasp as in claim 1, wherein said guiding arm includes a nose portion spaced forward of and in an overlapping relationship to said tab portion to provide a leading forward insertion portion for entry of said male insert member into said passageway.

3. A releasable clasp as in claim 2, wherein said nose portion includes a pair of opposing outwardly flared rearwardly extending cam surfaces for engaging walls of said mouth to guide the entry of said male insert member into said passageway.

4. A releasable clasp as in claim 2, wherein a seat portion is provided on a rearward side of said nose portion for abuttingly receiving said tab portion to limit deflection of said guiding arm.

5. A releasable clasp as in claim 1, wherein facing inner longitudinally extending edge surfaces of said guiding and locking arms are matingly stepped for engagement with each other when said guiding arm is deflected towards said locking arm.

6. A releasable clasp as in claim 5, wherein said inner longitudinally extending edge surface of said guiding arm is further stepped to increase a transverse length of an elongated slot disposed between said guiding and locking arms.

7. A releasable clasp as in claim 1, wherein a notch is provided rearward of said tab portion, said notch being a substantially inverted V-shaped cut having one angled surface extending from said tab portion and angled slightly less than a perpendicular angle from a lateral edge of said tab portion, and the other angled surface being a shallow angle from a lateral edge of said locking arm.

8. A releasable clasp as in claim 1, wherein said female receiving member is constructed from a single sheet of material folded to provide said passageway, said single sheet being overlapped along said second longitudinal edge, said abutment means being provided from an underlying sheet of said overlapped single sheet.

9. A releasable clasp as in claim 1, wherein connecting means are provided at opposite remote ends of said male insert member and said female receiving member for facilitating connection of articles to said male insert member and said female receiving member.

10. A releasable clasp comprising:

a female receiving member having opposing longitudinal side walls and opposing first and second longitudinal edges providing an elongated internal passageway extending from one end thereof, and a retaining slot positioned along said passageway, said retaining slot being an opening extending through said first longitudinal edge of said female receiving member, said passageway including a mouth at said one end;

a substantially flat elongated male insert member having a pair of elongated forwardly directed, spaced apart, springy arms insertable into said passageway, said springy arms being a guiding arm and a locking arm;

said guiding arm including an inwardly stepped surface longitudinally extending along a lateral edge from a free forward end thereof, said stepped surface terminating rearwardly at an outwardly extending shoulder disposed on said guiding arm;

said shoulder providing a cam surface for engaging a wall of said passageway mouth during insertion of said male insert member into said passageway so that said guiding arm is deflected towards said locking arm;

said locking arm including an outwardly extending tab portion at a forward end thereof for releasably locking into said retaining slot when said locking arm springs apart from said guiding arm when said male insert member has been inserted in a correct orientation with said locking arm being inserted adjacent to said first longitudinal edge of said female receiving member, said tab portion extending through said opening when in said correct orientation to securely retain said male insert member in said female receiving member in a locked position;

abutment means within said passageway to prevent full insertion of said guiding and locking arms into said passageway when said male insert member has been inserted in an incorrect orientation with said guiding arm being inserted adjacent to said first longitudinal edge of said female receiving member; and said shoulder being disposed a predetermined distance longitudinally rearwardly from said tab portion so that said stepped surface provides a thin leading forward insertion portion for entry of said male insert member into said passageway.

11. A releasable clasp as in claim 10, wherein said abutment means includes an abutment portion projecting into said passageway from said second longitudinal edge of said female receiving member, said abutment portion being disposed longitudinally closer to said mouth than said retaining slot.

12. A releasable clasp as in claim 10, wherein said guiding arm includes a nose portion spaced forward of and in an overlapping relationship to said tab portion to provide a leading forward insertion portion for entry of said male insert member into said passageway.

13. A releasable clasp as in claim 12, wherein said nose portion includes a pair of opposing outwardly flared rearwardly extending cam surfaces for engaging walls of said mouth to guide the entry of said male insert member into said passageway.

14. A releasable clasp as in claim 12, wherein a seat portion is provided on a rearward side of said nose portion for abuttingly receiving said tab portion to limit deflection of said guiding arm.

15. A releasable clasp as in claim 10, wherein facing inner longitudinally extending edge surfaces of said guiding and locking arms are matingly stepped for engagement with each other when said guiding arm is deflected towards said locking arm.

16. A releasable clasp as in claim 15, wherein said inner longitudinally extending edge surface of said guiding arm is further stepped to increase a transverse length of an elongated lot disposed between said guiding and locking arms.

17. A releasable clasp as in claim 10, wherein a notch is provided rearward of said tab portion, said notch being a substantially inverted V-shaped cut having one angled surface extending from said tab portion and angled slightly less than a perpendicular angle from a lateral edge of said tab portion, and the other angled surface being a shallow angle from a lateral edge of said locking arm.

18. A releasable clasp as in claim 10, wherein said female receiving member is constructed from a single sheet of material folded to provide said passageway, said single sheet being overlapped along said second longitudinal edge, said abutment means being provided from an underlying sheet of said overlapped single sheet.

19. A releasable clasp as in claim 10, wherein connecting means are provided at opposite remote ends of said male insert member and said female receiving member for facilitating connection of articles to said male insert member and said female receiving member.

* * * * *